US006490898B1

(12) United States Patent
Mottura

(10) Patent No.: US 6,490,898 B1
(45) Date of Patent: Dec. 10, 2002

(54) CYLINDER LOCK

(75) Inventor: Sergio Mottura, Torino (IT)

(73) Assignee: Mottura Serrature di Sicurezza S.p.A., Sant'Ambrogio (IT)

( * ) Notice: Subject to any disclaimer, the term of this patent is extended or adjusted under 35 U.S.C. 154(b) by 0 days.

(21) Appl. No.: 09/485,224

(22) PCT Filed: Feb. 7, 2000

(86) PCT No.: PCT/EP99/03132

§ 371 (c)(1),
(2), (4) Date: Apr. 6, 2000

(87) PCT Pub. No.: WO99/64703

PCT Pub. Date: Dec. 16, 1999

(30) Foreign Application Priority Data

Jun. 4, 1998 (IT) ..... T098A0491

(51) Int. Cl.[7] ..... E05B 27/00
(52) U.S. Cl. ..... 70/495; 70/409
(58) Field of Search ..... 70/494, 495, 496, 70/405–407, 409, 395, 378

(56) References Cited

U.S. PATENT DOCUMENTS

| | | | | | |
|---|---|---|---|---|---|
| 3,910,083 | A | * | 10/1975 | Burlingame | 70/378 |
| 3,990,282 | A | * | 11/1976 | Sorum | 70/419 X |
| 3,999,413 | A | * | 12/1976 | Raymond et al. | 70/495 |
| RE30,198 | E | * | 1/1980 | Oliver et al. | 70/409 X |
| 4,208,894 | A | * | 6/1980 | Surko, Jr. | 70/495 |
| 4,393,673 | A | * | 7/1983 | Widen | 70/409 X |
| 4,635,455 | A | * | 1/1987 | Oliver | 70/409 X |
| 4,638,651 | A | * | 1/1987 | Surko, Jr. | 70/495 |
| 4,667,495 | A | * | 5/1987 | Girard et al. | 70/409 X |
| 4,723,427 | A | * | 2/1988 | Oliver | 70/409 X |
| 4,815,307 | A | * | 3/1989 | Widen | 70/409 X |
| 4,977,767 | A | * | 12/1990 | Prunbauer | 70/406 |
| 4,998,426 | A | * | 3/1991 | Genakis | 70/494 |
| 5,067,335 | A | * | 11/1991 | Widen | 70/495 |
| 5,131,249 | A | * | 7/1992 | Baden et al. | 70/409 X |
| 5,375,444 | A | * | 12/1994 | Smith | 70/495 |
| 5,457,974 | A | * | 10/1995 | Keller | 70/409 X |
| 5,475,998 | A | * | 12/1995 | Raskevicius et al. | 70/495 |
| 5,517,840 | A | * | 5/1996 | Haggstrom | 70/495 |
| 5,533,369 | A | * | 7/1996 | Valdajos-Gallego | 70/409 X |
| 5,582,050 | A | * | 12/1996 | Haggstrom | 70/495 |
| 5,640,865 | A | * | 6/1997 | Widen | 70/495 |
| 5,682,779 | A | * | 11/1997 | Dolev | 70/494 |
| 5,724,841 | A | * | 3/1998 | Botteon | 70/409 X |
| 5,791,181 | A | * | 8/1998 | Sperber et al. | 70/496 |
| 5,839,308 | A | * | 11/1998 | Eizen et al. | 70/409 |
| 5,931,036 | A | * | 8/1999 | Keller | 70/495 |
| 5,956,986 | A | * | 9/1999 | Vonlanthen | 70/495 X |

FOREIGN PATENT DOCUMENTS

| | | |
|---|---|---|
| FR | 2 669 367 | 5/1992 |
| FR | 2 736 084 A | 1/1997 |
| GB | 2 214 226 | 8/1989 |
| WO | WO 96 27724 | 9/1996 |

* cited by examiner

*Primary Examiner*—Suzanne Dino Barrett
(74) *Attorney, Agent, or Firm*—Sughrue Mion, PLLC

(57) ABSTRACT

A cylinder lock comprises a cylinder (10) having a series of locking tumblers (16) which are rotatably mounted around respective axes. The introduction of the key causes rotation of each locking tumbler (16) to an operative position in which the tumblers enable the disengagement of a locking member (17) carried by the cylinder (10) from a seat formed in the stator (8) of the lock.

7 Claims, 7 Drawing Sheets

CYLINDER LOCK

BACKGROUND OF THE INVENTION

The present invention relates to cylinder locks of the type comprising a lock body or stator, a cylinder or rotor, rotatably mounted within the body and having a passage for introduction of a key, and a plurality of locking tumblers mounted within the cylinder and having their axes arranged radially, said tumblers being provided for engagement by a key having a predetermined profile in order to be arranged in a condition in which they enable the free rotation of the cylinder within the lock body, wherein each of said locking tumblers is mounted within said cylinder with the possibility to rotate around its axis, said lock further comprising:

means provided on the key and on said tumblers cooperating with each other to cause rotation of each tumbler around its axis, towards a predetermined operative position, upon introduction of the key into the cylinder, and a locking member carried by the cylinder and biased by spring means towards an extracted position in which it engages a cooperating seat within the body, said locking member being free to be withdrawn to a position of disengagement from said seat when the tumblers are rotated to said operative position upon introduction of the key.

Cylinder locks of the above-indicated type are disclosed for example in WO-A-9627724 and FR-A-2736084. In these known locks, each of the above-mentioned rotating tumblers is also slidable axially within a respective bore in the cylinder and is biassed towards the keyway by a respective spring arranged in the bore. The engaging key has a flat surface with a number of spaced apart depressions into which the tumbler tips engage under the action of the biassing springs once the key is fully inserted into the keyway. This arrangement is relatively complicated and costly. Moreover, the provision of the springs renders the device not fully reliable, since the springs may become weaker or be damaged as a result of ambient temperature variations.

The object of the present invention is that of providing a lock of the above indicated type which ensures a high degree of safety and is adapted to provide an extremely high number of different key configurations. A further object of the invention is that of reaching the above indicated result with a lock having a structure which is relatively simple, of low cost and reliable in operation.

STATEMENT OF THE INVENTION

In view of achieving the above indicated objects, the lock according to the invention is characterised in that each of said locking tumblers (16) is mounted within said cylinder (10) at a fixed position along the tumbler axis, and in that said means for causing rotation of said tumblers (16) comprises at least one front finger (23) projecting from each locking tumbler (16) and offset relative to the tumbler axis, and at least one shaped continuous slot (23) formed on at least one face (6) of the key (3) and able to receive the offset fingers (23) of the tumblers (16).

In one embodiment, the above mentioned locking rotatable tumblers, are provided in two aligned series on two opposite sides of the passage for introduction of the key. In an alternative embodiment, the lock comprises, in addition to the above mentioned series of rotatable tumblers, a further series of locking tumblers which are radially slidably mounted within the cylinder and are provided to be engaged by the key in order to be arranged in a position in which they enable the free rotation of the cylinder within the body, said rotatable tumblers and said slidable tumblers being arranged in two aligned series on two opposite sides of the passage for introduction of key, said key having a plurality of cavities, adapted to cause actuation of the slidable locking tumblers, on one of its faces, said shaped slot being formed on an opposite face of the key. Preferably, the key has, on its face bearing said cavities, at a position arranged side by side to said cavities, also said means adapted to cause actuation of the rotatable locking tumblers, whereas on the opposite face, at a position arranged side by side to said means for actuating the rotatable tumblers, there is provided a series of cavities adapted to cause actuation of the slidable locking tumblers, so that the key may be used at any one of two positions rotated by 180° relatively to each other.

According to a further preferred feature, the key has an axial slot at its end, within which there is arranged a ring mounted with clearance over a transverse pin and adapted to cooperate with an abutment pin which is secured within the cylinder and projects into the passage for the key, so as to push a further locking tumbler carried by the cylinder towards a cylinder freeing position.

Furthermore, the lock according to the invention is preferably characterised in that each rotatable tumbler is constituted by two axially superimposed portions having facing ends having surfaces for there mutual engagement in rotation, so that said portions may be positioned at different relative angular positions, spring means being interposed between said portions for tending to move them axially away from each other, said lock being provided with a first special auxiliary key adapted to be introduced into the passage in the cylinder and able to be withdrawn at a predetermined rotated position of the cylinder, which is intermediate between the opening and closing positions of the lock, at which intermediate position the radially outer portions of the rotatable tumblers are free to engage cooperating cavities in the stator, so that they move apart from the respective radially inner portions of the rotatable tumblers under the action of said spring means, said lock being further provided with one auxiliary change key adapted to be introduced into the cylinder passage when the cylinder is at said intermediate position in order to rotate the cylinder back to the start position, causing again the mutual engagement of the two portions forming each rotatable tumbler, said change key being provided with means for driving rotation of the rotatable tumblers which are different from those provided on the original key of the lock, so that when the two portions constituting each rotatable tumbler return into engagement with each other they assume a different relative angular position, so that the lock is programmed for a key different from the above mentioned original key.

BRIEF DESCRIPTION OF THE DRAWINGS

Further features and advantages of the invention will be come apparent from the description which follows with reference to the annexed drawings, given purely by way of non-limiting example, in which.

DETAILED DESCRIPTION OF THE INVENTION

Figure 1:
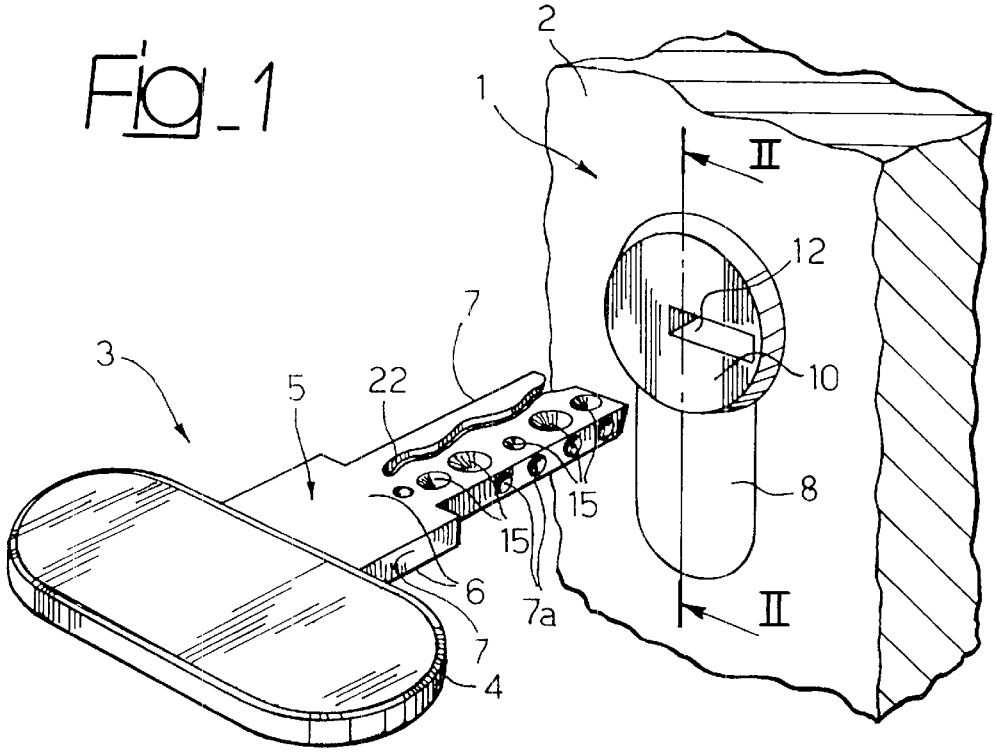
FIG. 1 is a perspective diagrammatic view of a lock according to the invention.

In FIG. 1, reference numeral 1 generally designates a cylinder lock mounted within a dwelling door 2 (shown only partially) and associated with a key 3 having a handling portion 4 and a blade body 5 with two opposite faces 6 and two longitudinal edges 7.

Figure 2:
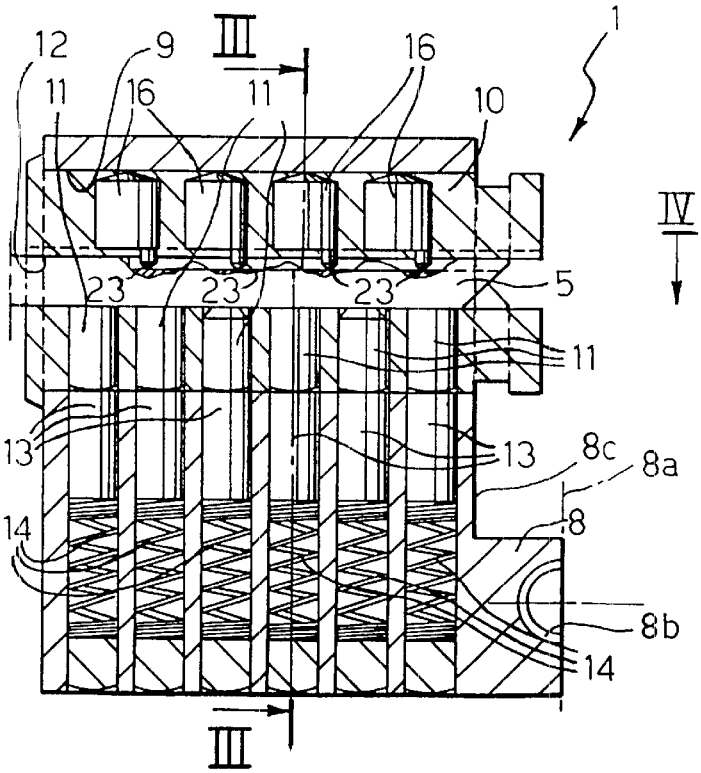
FIG. 2 is a view in cross-section taken along line II—II of FIG. 1.
Figure 3:
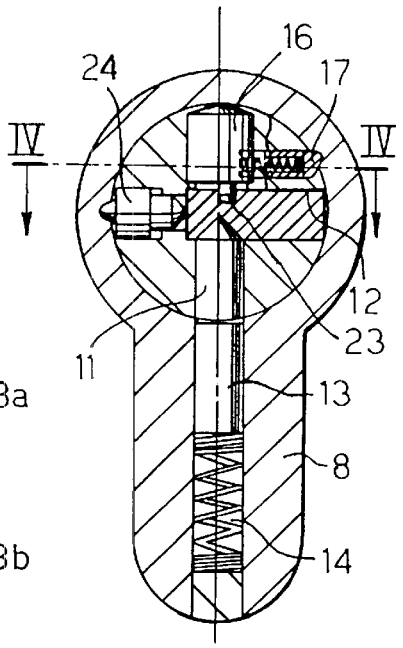
FIG. 3 is a view in cross-section taken along line III—III of FIG. 2.

With reference to FIGS. 2,3, the lock 1 comprises a body or stator 8 through which a cylindrical cavity 9 is formed wherein a cylinder or rotor 10 is rotatably mounted. FIG. 2 actually shows only one half of body 8, the other half being not shown, since it is identical and symmetrical relative to a symmetry plane designated by 8*a*. At this plane, body 8 has, in a way known per se, a threaded hole (only partially shown and designated by 8*b*) for engagement of a screw for securing the lock to the door. The half portion of body 8 which is not illustrated is provided with a cylinder which is identical and symmetrical to cylinder 10, for engagement of a key from the side of the door opposite to that at which the illustrated cylinder 10 is provided. Naturally, the description of the parts which are not illustrated is omitted, since they are identical and symmetrical to the parts which are shown.

Furthermore, the present invention is anyhow applicable even to the case that the lock includes a single rotatable cylinder which is accessible only from one side of the door. Furthermore, the drawings do not show the conventional rotatable bolt, which is connected in rotation to cylinder 10 and is arranged within the gap 8*c* which is not occupied by the body of stator 8, for controlling opening and closing of the door. These details of construction have not been illustrated since, as already indicated, they can be made in any known way, and they do not fall within the scope of the invention. Furthermore, the deletion of these details from the drawings renders the latter simpler and easier to understand.

According to the conventional art, in the embodiments of FIGS. 1–17, within cylinder 10 there is arranged a first series of locking tumblers 11 which are radially slidably mounted within respective radial cavities formed within cylinder 10 and opening on a passage 12 formed axially through cylinder 10, for introduction of the key 3. Also according to the conventional art, the locking tumblers 11 cooperate with counter-tumblers 13 radially and slidably mounted within body 8 and biased by springs 14 against the locking tumblers 11. Also according to the conventional art, the locking tumblers 11 have end tips adapted to cooperate with a shaped profile which in the illustrated example, is defined by plurality of cavities 15 formed on one or both of faces 6 of key 3. In this manner, the key authorised to open the lock is able, once inserted into passage 12, to cause excel movement of locking tumblers 11 to the operative position shown in FIG. 2, in which they do not project beyond the outer surface of cylinder 10, so that they do not prevent a rotation of cylinder 10 relative to body 8.

According to the invention, there is provided series of locking tumblers 16 which are arranged on one side of passage 12 opposite to that of the slidable locking tumblers 11. Each of the locking tumbler 16 is mounted at a fixed position along its axis but is able to rotate around this axis. Reference numeral 17 (see also FIGS. 4,5 and 6) designates a secondary locking member slidably mounted within cylinder 10 in a direction orthogonal to a plane containing the axis of cylinder 10 and biased by springs 18 towards a position of engagement of a seat 19 formed in the wall of body 8 defining the cylindrical cavity 9. Each rotatable locking tumbler 16 is able to be brought to an operative position (see FIGS. 4,5) in which an axial slot 20 formed thereon faces a cooperating nose 21 of the secondary locking member 17. Therefore, in this position the secondary locking member 17 is able to be withdrawn to a position of disengagement of seat 19, as a result of a rotation imparted to cylinder 10 by the key, due to the cam-like chamfered profile of the locking member 17.

Figure 4:
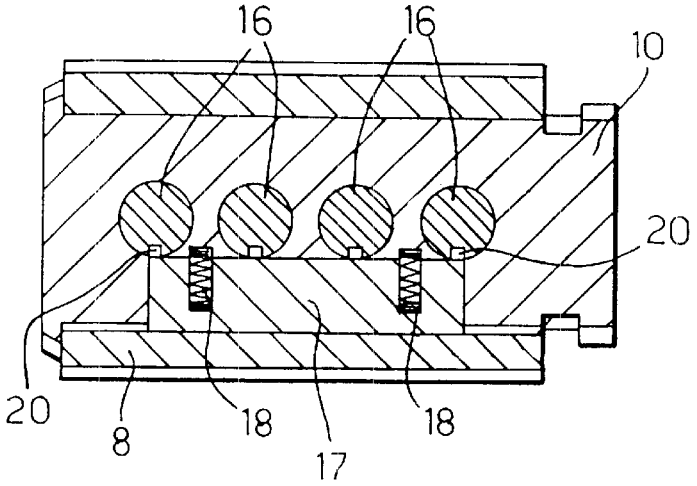
FIG. 4 is a view in cross- section taken along line IV—IV of FIG. 3, at an enlarged scale.
Figure 5:
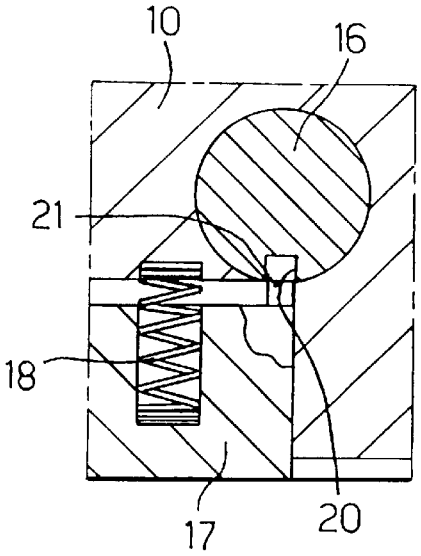
FIG. 5 is a view at an enlarged scale of a detail of FIG. 4.
Figure 6:
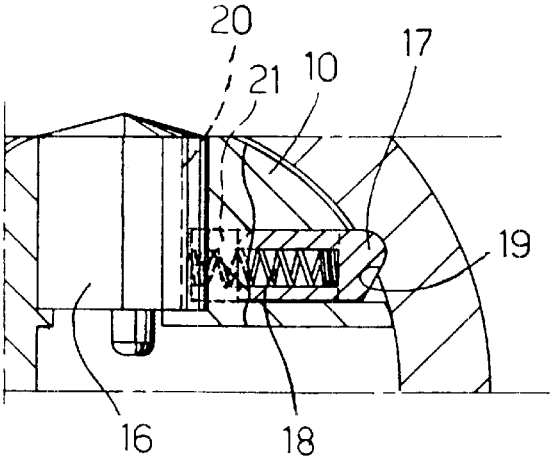
FIG. 6 is a view at an enlarged scale of a detail of FIG. 3.
Figure 7:
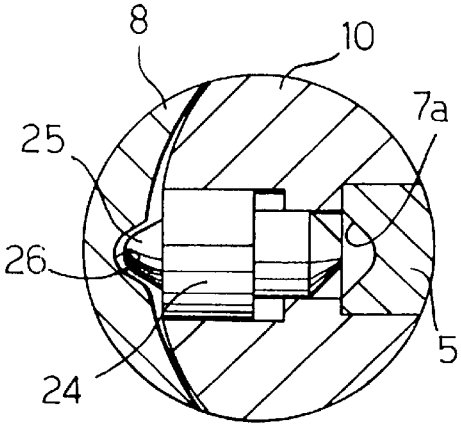
FIG. 7 is a view at an enlarged scale of a further detail of FIG. 3.
Figure 8:
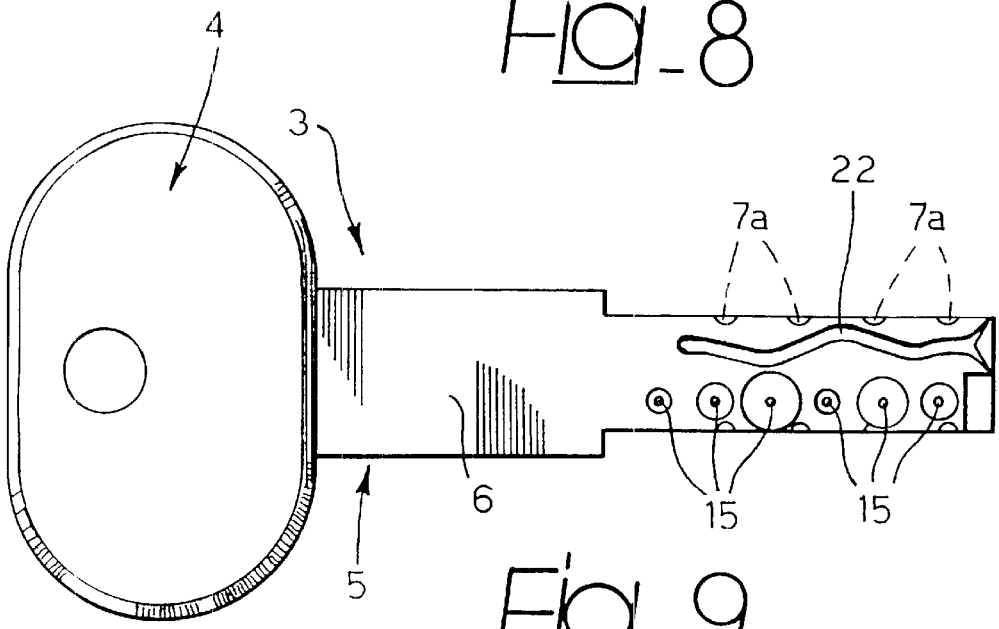
FIG. 8 is a front view of the key shown in FIG. 1.
Figure 9:
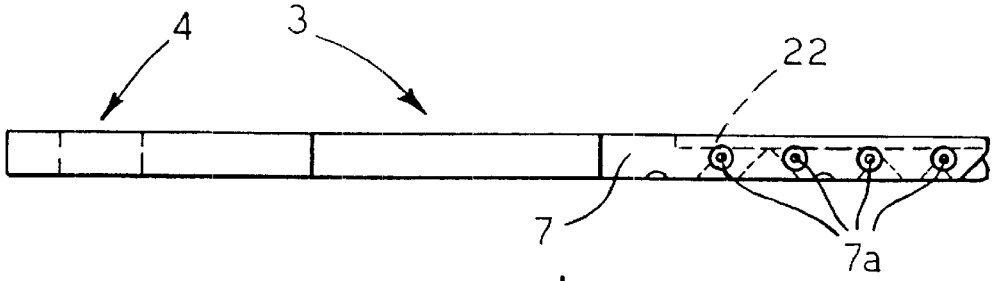
FIG. 9 is a side view of the key of FIG. 8.

The rotation of locking tumblers 16 towards their operative positions shown in FIG. 4 is obtained upon introduction of the authorized key, since the latter has a longitudinal shaped slot 22 (see FIGS. 1,8–10)within which front fingers 23 are engaged which project from tumblers 16 within passage 12, these fingers being offset relative to the respective tumbler axes.

Figure 10:
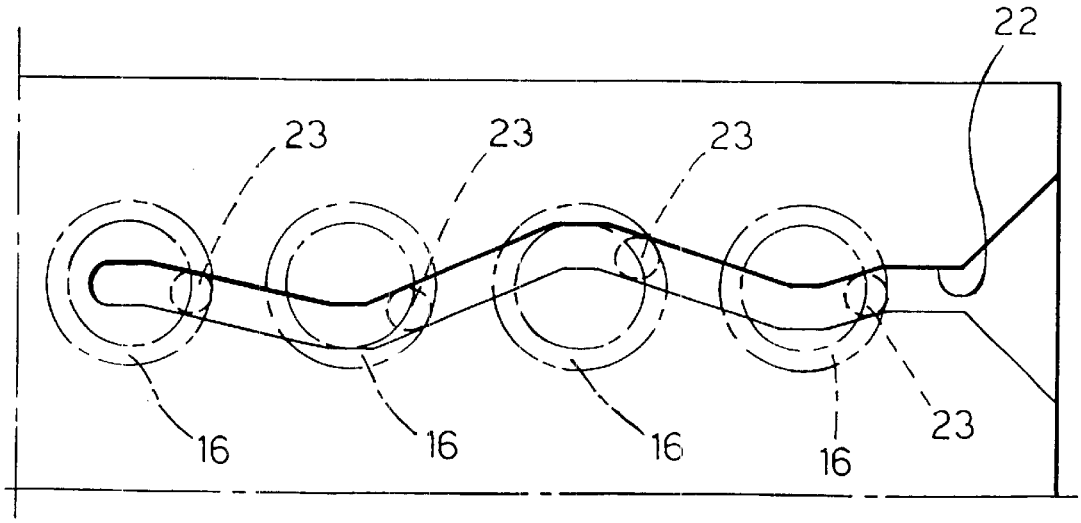
FIG. 10 is a diagrammatic view showing the principle of operation of the lock according to the invention, FIGS. 11–13 relate to a variant of FIGS. 1–3.

FIG. 10 diagrammatically shows how the engagement of the offset fingers 23 into slot 22 causes different angular positions of the tumblers 16. Naturally, by differently shaping the slot 22 it is possible to obtain different rotations of each locking tumbler 16, which enables different possible opening combinations to be provided. These combinations, multiplied by the combinations which can be provided due to the locking tumblers 11, give rise to an extremely high number of different opening combinations, corresponding to an identical number of different keys.

In the embodiment which has been illustrated, the key 3 has a series of cavities 15 on each of its two opposite faces 6, which are able to activate the locking tumblers 11, as well as a shaped slot 22 adapted to activate the locking tumblers 16. In this manner, the key 3 can be used both in a given a orientation (as that illustrated in FIG. 1) as well as in the opposite orientation. In both cases, the key occupies the passage 12 shown in FIG. 3, so that one of its faces is able to actuate the slidable locking tumblers 11, whereas the opposite face is able to actuate the rotatable locking tumblers 16.

According to a further feature, each of the longitudinal edges 7 of the key 3 has a plurality of notches 7*a* adapted to cooperate with stop pins 24 (FIG. 7)slidably mounted within cylinder 10 and having a conical tip 25 adapted to engage a cooperating conical seat 26 formed in the wall of body 8 defining the cylindrical cavity 9 when the cylinder is in the opening or closing position of the lock. These elements serve as further references of the operative position of the key and prevent withdrawal of the key when the cylinder is at a position intermediate between the opening and closing position of lock, since in this case the pins 24 are not able to come out of the respective notches 7*a*.

Figure 11:
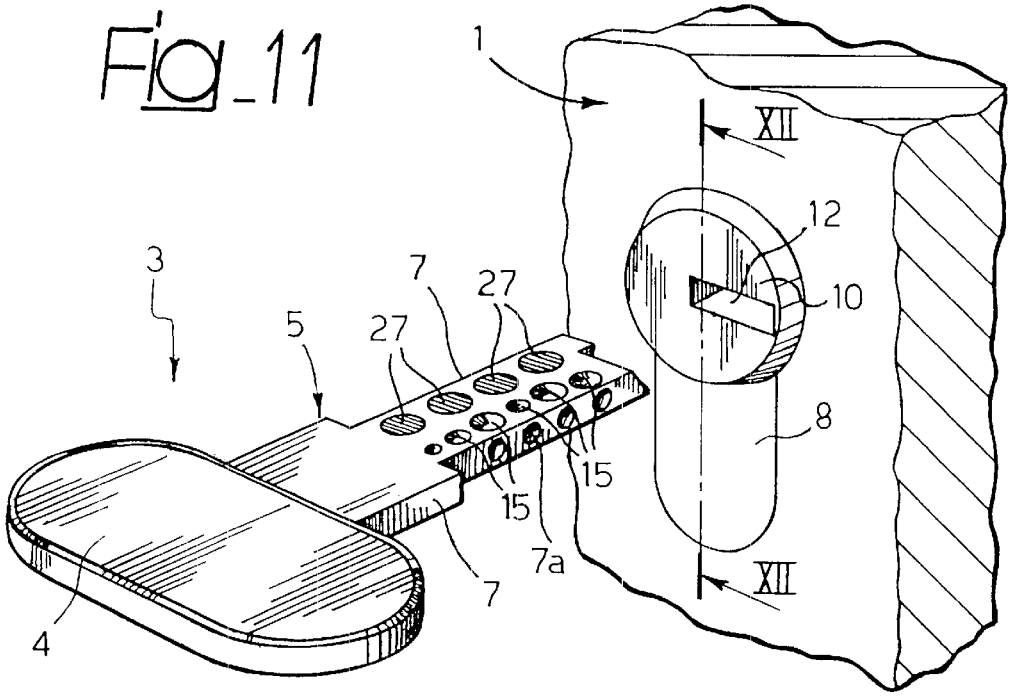
Figure 12:
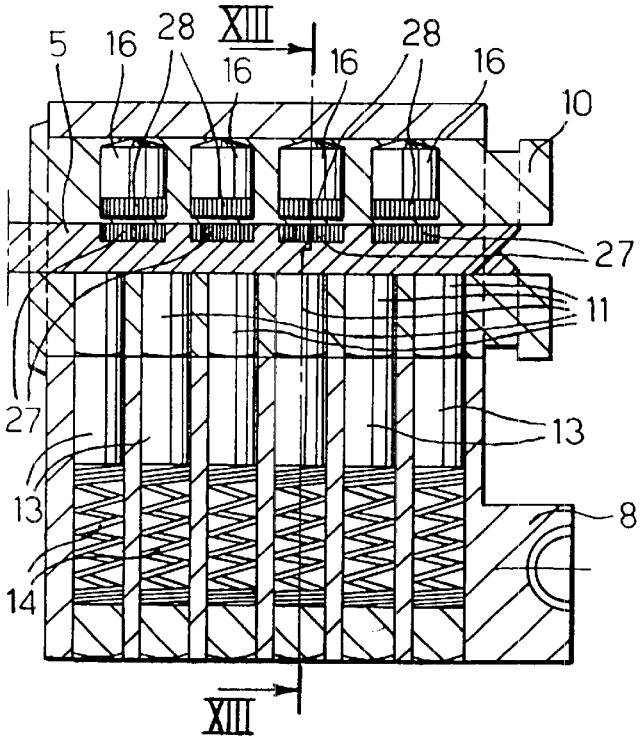
Figure 13:
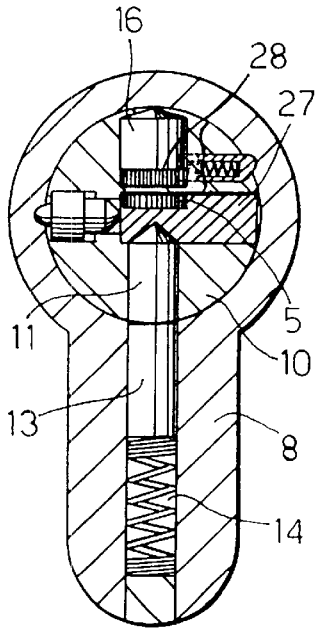
Figure 14:
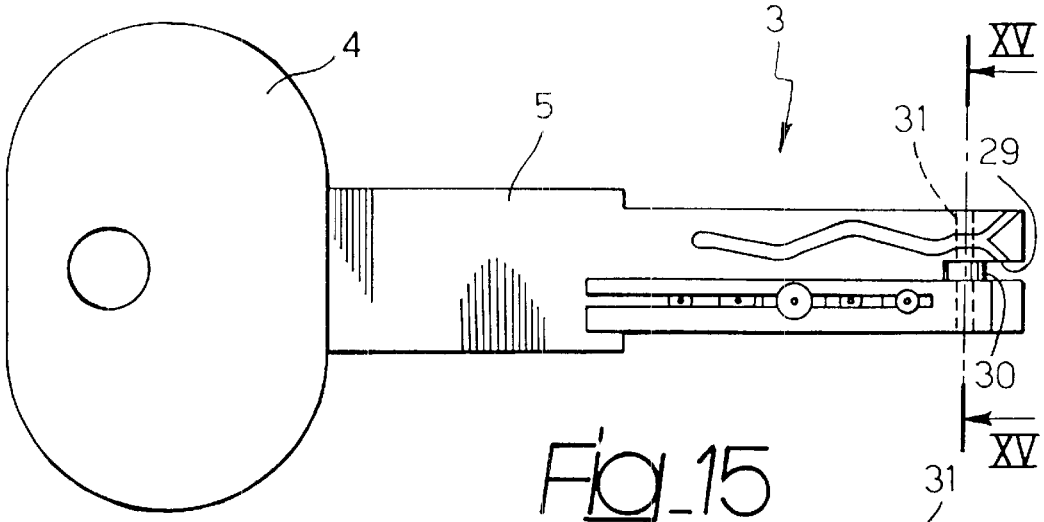
FIG. 14 shows a further variant of FIG. 8.

FIGS. 11–13 relate to a variant which differs from that described above only for the way in which rotation of the locking tumblers 16 is obtained. In these figures, the parts in common with those of FIGS. 1–3 are designated by the same reference number. In this case, in lieu of shaped slot 22 and the offset fingers 23, key 3 and tumblers 16 are respectively provided with permanent magnets 27,28 which are arranged in such a way that the introduction of the key causes orientation of the magnet 28 by an angle needed to bring each tumbler 16 to its operative position.

Figure 15:
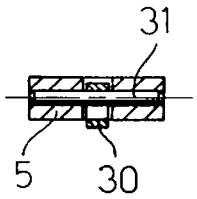
FIG. 15 is a view in cross-section of FIG. 14, FIGS. 16,17 are variants of FIGS. 2,3 which relate to a lock using the key of FIGS. 14,15.
Figure 16:
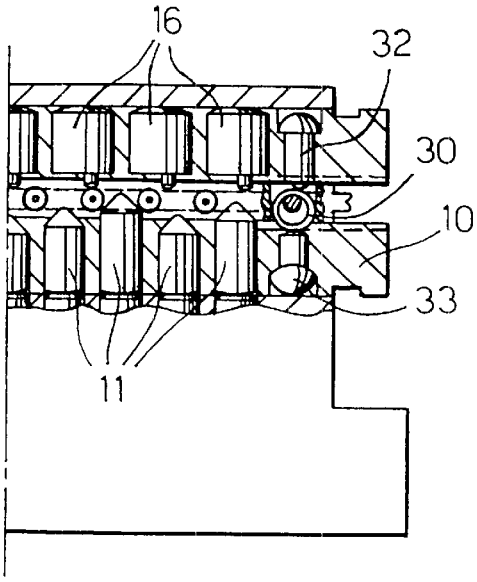
Figure 17:
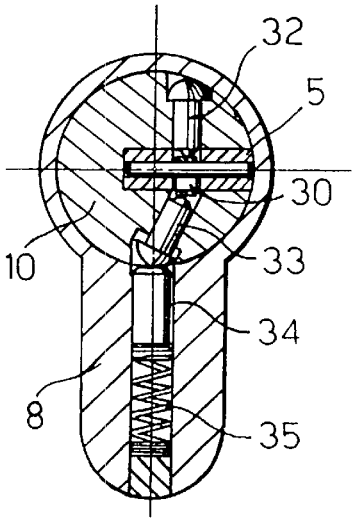

Finally, FIGS. 14–17 relate to a further additional feature which is preferably provided in the lock according to the invention in order to render even more difficult to obtain a non-authorized duplication of the key. In this embodiment, the key 3 has a longitudinal slot 29 at its end in which a ring 30 is arranged which is mounted on a cylindrical pin 31 secured transversally on the key. The ring 30 has a diameter substantially greater than that of cylindrical pin 31, so that it rests thereon in an offset position, as shown in FIG. 15. When the key is introduced, the ring 30 comes into engagement with the end of an abutment pin 32, secured to cylinder 10 and projecting centrally within passage 12, so that ring 30 projects from the key and is pushed against a further locking pin 33 which is slidable within cylinder 10 and cooperates with a counter-pin 34 (FIG. 17) which is thus pushed against the action of a spring 35, to a position in which it leaves the cylinder 10 free. The ring 30 therefore fulfils also the function of providing further safety, since a key without ring 30 is not able to push pin 33 towards the unlocking position.

Figure 18:
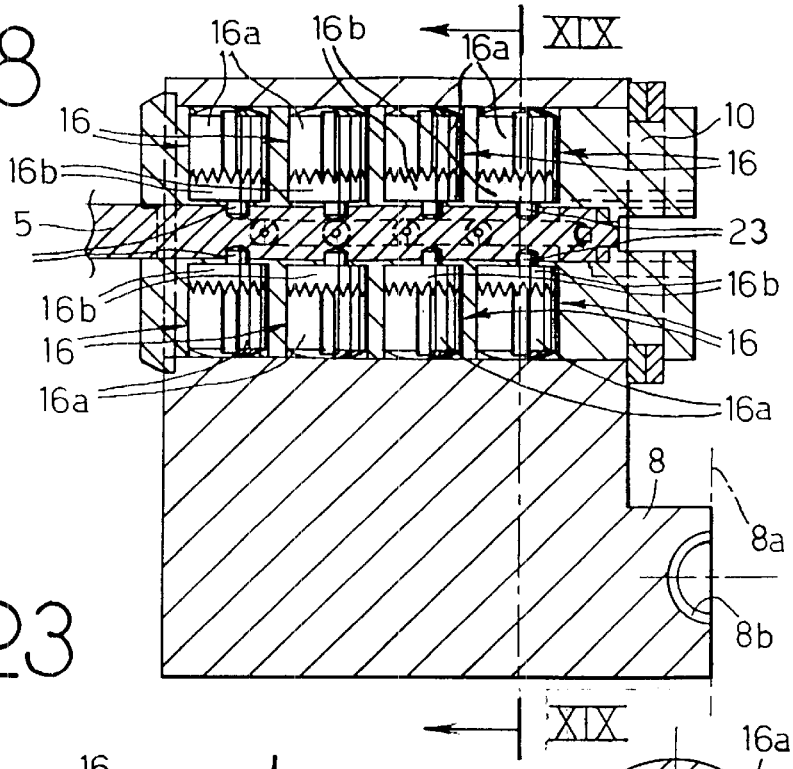
FIG. 18 is a view in cross-section of a further embodiment of the lock according to the invention.
Figure 23:
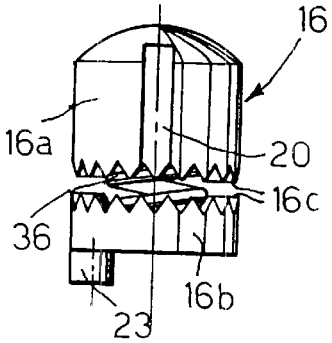
FIG. 23 is an elevational of view of a tumbler of the lock of FIG. 18.
Figure 24:
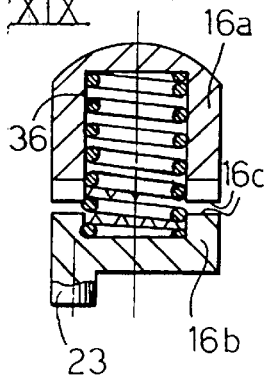
FIG. 24 is a cross-sectional of view of the tumbler of FIG. 23.

Naturally, according to the invention it would be possible to provide only a series of rotatable tumblers 16, thus eliminating the slidable tumblers 11. It could be also possible to provide two opposite series of rotatable tumblers 16, as shown in FIG. 18. The variant shown in this figure as well as in the remaining FIGS. 19–22 further differs for an other feature of tumblers 16, which however is applicable to all the embodiments of the invention. This feature lies in that each rotatable tumbler 16 is constituted by two portions 16*a*, 16*b* (see FIGS. 23,24) which are axially superimposed upon each other and have facing ends having surfaces provided with front teeth 16c for their mutual engagement in rotation, adapted to enable portions 16*a*, 16*b* to be positioned at different relative angular positions with respect to there common axis. Between each pair of portions 16*a* , 16*b* forming a tumbler 16 there is interposed a helical spring 36 tending to move the two portions 16*a*, 16*b* away from each other. The lock shown in FIG. 18 is to be provided with a key 3 of the type shown in FIG. 25, having a pair of slots 22 on each face of its blade 5, these slots 22 being adapted to cooperate with the front fingers 23 of the two series of rotatable tumblers 16, according to what has been illustrated above. As already indicated above, furthermore, the key has a number of notches 7*a* on its two longitudinal edges which are for cooperation with the locking pins 24 carried by the stator 8. Also as already indicated above, in the opening and closing positions of the lock, in which the blade 5 of the key is arranged horizontally (with reference for example to FIG. 19) the locking pins 24 do not prevent introduction and withdrawal of the key, since they can be received into cavities 26 of stator 8, as already described above. In any intermediate slant position of the blade 5 of the key, the pins 24 are not free instead to come out of notches 7*a* on the two edges of the key, so that the latter can not be withdrawn from the lock.

Figure 25:
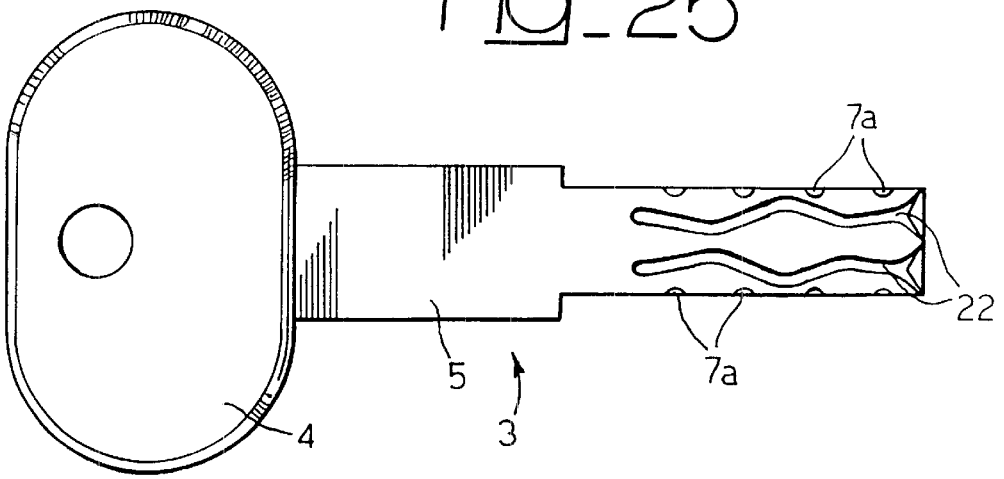
FIG. 25 is a view of the key of the lock of FIG. 18.

According to the invention, the lock shown in FIGS. 18–23 is provided, in addition to the regular original key 3 shown in FIG. 25, also with an auxiliary special key which is identical to that shown in FIG. 25 except for that the side notches 7*a* are replaced on each side by a continuous slot which avoids any interference with the locking pins 24. This special auxiliary key is shown in cross-section in FIGS. 19,20, where the blade of this key is designated by 5' and the longitudinal continuous slots on the two sides of the blade 5' are designated by 37. As shown, the special auxiliary key described above has the feature that once it is introduced into the lock in the condition shown in FIG. 19 it is able to drive the lock and to be withdrawn therefrom even at an intermediate position, as that shown in FIG. 20, since the slots 37 (only one of which is active, as a function of the orientation of the key when it is introduced in the lock) avoid the interference between the key and the locking pins 24 when the key is withdrawn. Furthermore, the stator 8 is formed with two diametrically opposite cavities 38, where portions 16*a* of the two rotatable tumblers 16 can expand when the cylinder 10 is brought to a predetermined position which is specifically shown in FIG. 20 and which, in the considered example is spaced by 120° from the start position shown in FIG. 19. As shown, in this position, the two tumblers 16 are free to expand under the action of the respective springs 36, so that the facing teeth 16*a* of each tumbler 16 move away from each other. In the condition shown in FIG. 20, the portion 16*a* of each tumbler 16 still has its slot 20 engaged by a respective finger 21 of the locking member 17, whereas portion 16*b* (which has no slot)has its front finger 23 engaged within the respective slot 22 of the key.

Figure 20:
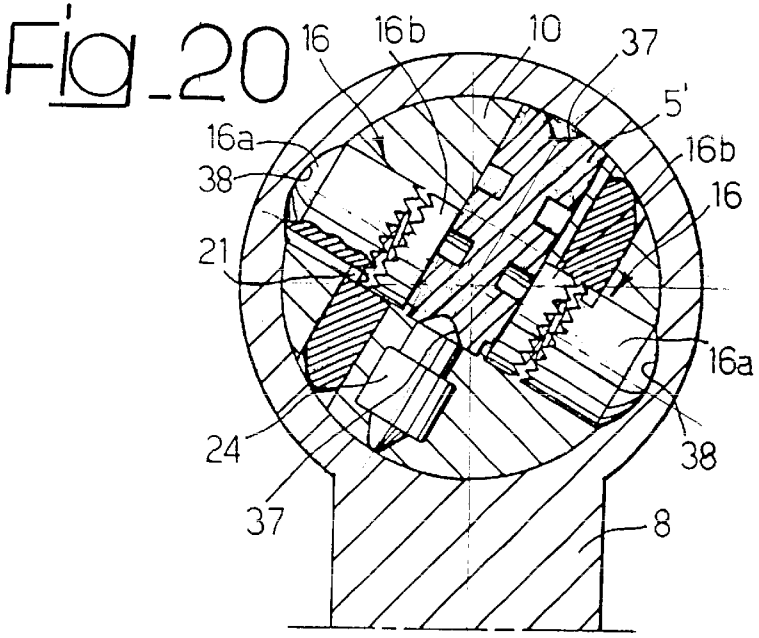
FIGS. 19,20 show a cross-section taken along line XIX—XIX of FIG. 18 in two different operative conditions of the lock.
Figure 22:
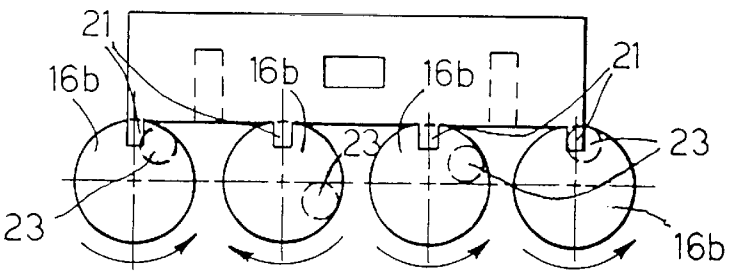
FIGS. 21,22 are diagrammatic cross-section of views taken along line XXI—XXI and XXII—XXII of FIGS. 19,20.
Figure 19:
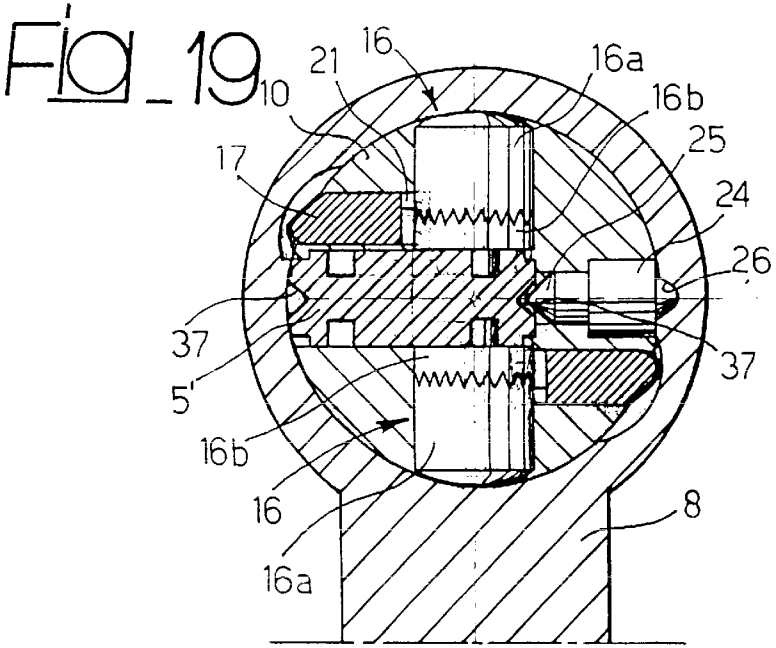
Figure 21:
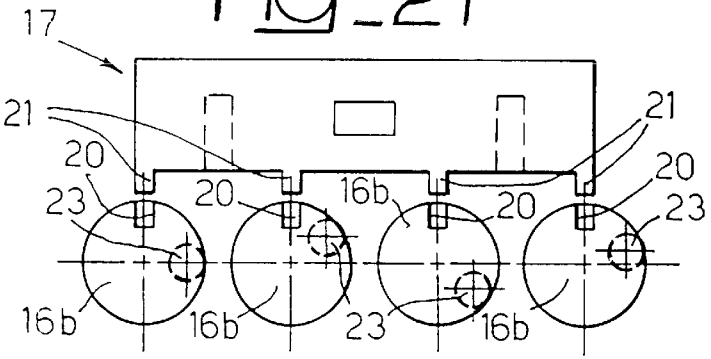

By using the special auxiliary key which has been described above, the lock thus can be brought from the condition shown in FIG. 19 to the condition shown in FIG. 20 and left in this condition by withdrawing the key, this withdrawal being not prevented by the locking pins 24 since, as indicated already, the special key has two continuous slots 37 on its two longitudinal edges. If the user wishes to re-program its lock with a new combination, corresponding to a key having a slot 22 of different shape, he will insert a second special auxiliary key, which is also called "change key" which is again characterised by having two longitudinal side continuous slots as the first special auxiliary key, so that it can be introduced into the lock when the cylinder 10 is at the position shown in FIG. 20, the change key having slots 22 of a shape different from that of the key originally provided for the lock. The introduction of the change key into the cylinder 10, will cause engagement of the front fingers 23 into the newly shaped slots 22 of the key, so that the portions 16*b* of tumblers 16 are caused to rotate around their axes relative to the cooperating portions 16*a*, which instead remain fixed. At this time, the rotor 10 can be brought back to the start position shown in FIG. 19 by means of the change key, which is then withdrawn. As soon as the cylinder 10 moves away from the position shown in FIG. 20, portions 16*a*, 16*b* of each tumbler 16 are caused to engage again with each other in a relative angular position which however has changed with respect to that provided initially (as apparent from a comparison of FIG. 22 with FIG. 21). From this time onwards, therefore, the lock can be driven by a new key of the type shown in FIG. 25 which however has a shape of the slot 22 identical to that of the change key which has been used. Therefore, the user has the possibility to adapt the lock to a new key any time that safety needs suggests so (such as when the original key has been given to non-authorised persons for a prolonged time).

Naturally, the provision of tumblers 16 made of two portions, as well as their structure has described above, can be applied, as already indicated, not only to the case of the lock shown in FIG. 18, but also to any other lock of those shown in the remaining annexed drawings, or in any further embodiment provided with the rotatable tumblers of the invention.

From the foregoing description it is clearly apparent that the lock according to the invention has a high degree of safety and in particular is able to provide an extremely high number of different opening combinations, corresponding to an identical number of different keys. The lock can then be manufactured and marketed with no practical limitations from the stand point of the number of possible combinations.

At the same time, the lock has an efficient and reliable operation and has a structure which is relatively simple and of low cost.

Naturally, while the principle of the invention remains the same, the details of construction and the embodiments may widely vary with respect to what has been described and illustrated purely by way of example, without departing from the scope of the present invention.

For instance, each tumbler 16 could be provided with more than one finger 23.

What is claimed is:

1. Cylinder lock comprising a lock body or stator (8), a cylinder or rotor (10), rotatably mounted within the body (8) and having a passage for introduction of a key (3), and a plurality of locking tumblers (11) mounted within the cylinder (19) and having their axes arranged radially and provided for being engaged by a key having a predetermined profile in order to be arranged in a position in which they enable the free rotation of the cylinder (10) within the body (8), wherein each of said locking tumblers (16) is mounted within said cylinder (10) with the possibility to rotate around an axis of the tumbler, said lock further comprising:

means provided on the key (3) and on said tumblers (16) cooperating with each other to cause rotation of each tumbler (16) around the axis of the tumbler, towards a predetermined operative position, upon introduction of the key (3) into the cylinder (10), and a locking member (17) carried by the cylinder (10) and biased by spring means (18) towards an extracted position in which the locking member engages a cooperating seat (19) within the body (8), said locking member (17) being free to be withdrawn to a position of disengagement from said seat (19) when the tumblers (16) are rotated to said operative position upon introduction of the key, wherein each of said locking tumblers (16) is mounted within said cylinder (10) at a fixed position along the tumbler axis, and in that said means for causing rotation of said tumblers (16) comprises at least one front finger (23) projecting from each locking tumbler (16) and offset relative to the tumbler axis, and at least one shaped continuous slot (23) formed on at least one face (6) of the key (3) and able to receive the offset fingers (23) of the tumblers (16).

2. Cylinder lock according to claim 1, wherein said locking tumblers 16) are provided in two aligned series on two opposite sides of the passage (12) for introduction of the key.

3. Cylinder lock according to claim 1, wherein the lock comprises a further series of locking tumblers (11) which are slidably radially mounted within the cylinder (10) and are provided for being engaged by the key in order to be arranged in a position in which they enable the free rotation of the cylinder (10) within the body (8), said rotatable tumblers (16) and the slidable tumblers (11) being provided in two aligned series on two opposite sides the passage (12) for introduction of the key, said key (3) having a plurality of cavities (15), adapted to cause actuation of the slidable locking tumblers (11) on one face of the key and said shaped slot (22) on an opposite face.

4. Cylinder lock according to claim 3, wherein the key (3) has, on said face having said cavities (15), at a position arranged side by side with the cavities (15), also means (22;27) for causing actuation of the rotatable locking tumblers (16), whereas on the opposite side, arranged side by side with said means (22;27) for actuating the rotatable tumblers (16), there is provided a series of cavities (15) for actuating the slidable locking tumbler (11) so that the key (3) can be used at any of two positions rotated by 180° relative to each other.

5. Cylinder lock according to claim 1, wherein the key (3) has one end with an axial slot (29) within which there is arranged a ring (30) mounted with clearance on a transverse pin (31) and adapted to cooperate with an abutment pin (32) secured within the cylinder (10) and projecting into the passage (10) for the key, so as to push a further locking pin (33) carried by the cylinder towards a cylinder freeing position.

6. Cylinder lock according to claim 1, wherein each rotatable tumbler (16) comprises two axially superimposed portions **(16*a*, 16*b*) having facing ends having surfaces (16*c*) for their mutual engagement in rotation, which enable said portions to be positioned at different at a different relative angular positions, spring means (369) being interposed between said portions (16*a*, 16*b*) tending to move them axially away from each other, said lock being further provided with a first special auxiliary key (5') adapted to be introduced into the passage (12) of the cylinder (10) as well as to be withdrawn at a predetermined rotated position of the cylinder (10), intermediate between the opening and closing positions of the lock, in which the radially outer portions (16*a*) of the rotatable tumblers (16) are free to engage cooperating cavities (38) of the stator (8), so as to move apart from the respective radially inner portions (16*b*) of the rotatable tumblers (16) under the action of said spring means (36), said lock being further provided with at least one auxiliary change key adapted to be introduced into the passage of the cylinder (10) when the cylinder is at said intermediate position and to rotate the cylinder back to the start position, causing again the mutual engagement of the two portions (16*a*, 16*b*) constituting each rotatable tumbler (16), said change key being provided with means (22) for driving rotation of the rotatable tumblers (16) which are different from those provided on the original key (3) of the lock, so that when the two portions (16*a*, 16*b*) constituting each rotatable tumbler (16)** come back into engagement with each other at a different relative angular position, so that the lock is programmed for a key different from said original key

7. Key for use in a cylinder lock of the type comprising a lock body or stator, a cylinder or rotor which is rotatably mounted within said stator and having a passage for introduction of the key, and a plurality of locking tumblers mounted within the cylinder and adapted to be engaged by the key when the latter is introduced into said passage in order to be arranged at positions where they enable a free rotation of the cylinder within the stator, said key having one end with an axial slot (29) within which there is arranged a ring (30) mounted with clearance on a transverse pin (31) and adapted to cooperate with an abutment pin (32) secured within the cylinder (10) and projecting into the passage (10) for the key, so as to push a further locking pin (33) carried by the cylinder towards a cylinder freeing position.

* * * * *